US009175557B2

(12) United States Patent
Iversen et al.

(10) Patent No.: US 9,175,557 B2
(45) Date of Patent: Nov. 3, 2015

(54) DRILLING CONTROL METHOD AND SYSTEM

(75) Inventors: Fionn Iversen, Bønes (NO); Eric Cayeux, Sandnes (NO)

(73) Assignee: Drilltronics Rig System AS, Stavanger (NO)

( * ) Notice: Subject to any disclaimer, the term of this patent is extended or adjusted under 35 U.S.C. 154(b) by 688 days.

(21) Appl. No.: 13/254,734

(22) PCT Filed: Mar. 1, 2010

(86) PCT No.: PCT/NO2010/000081

§ 371 (c)(1),
(2), (4) Date: Nov. 18, 2011

(87) PCT Pub. No.: WO2010/101473

PCT Pub. Date: Sep. 10, 2010

(65) Prior Publication Data

US 2012/0059521 A1 Mar. 8, 2012

(30) Foreign Application Priority Data

Mar. 2, 2009 (NO) ..... 20090935

(51) Int. Cl.
*G06F 19/00* (2011.01)
*E21B 44/00* (2006.01)

(52) U.S. Cl.
CPC ..... *E21B 44/00* (2013.01)

(58) Field of Classification Search
CPC ..... E21B 44/00
USPC ..... 700/275; 166/285, 272.1, 272.6, 250.07
See application file for complete search history.

(56) References Cited

U.S. PATENT DOCUMENTS 4,407,017 A 9/1983 Zhilikov et al.
4,794,535 A 12/1988 Gray et al.

(Continued)

FOREIGN PATENT DOCUMENTS

EP 0857249 8/1998
GB 2371366 7/2002

(Continued)

OTHER PUBLICATIONS

Nygaard et al. "Evaluation of Drillstring and Casing Instrumentation Needed for Reservoir Characterization During Drilling Operations", SPE/IADC Middle East Drilling Technology Conference and Exhibition, Sep. 12-14, 2006.

(Continued)

*Primary Examiner* — Michael D Masinick
(74) *Attorney, Agent, or Firm* — O'Shea Getz P.C.

(57) ABSTRACT

Method and system for drilling control comprising a plurality of controllers adapted to control performance process parameters, on the basis of driller controls from a driller that provides this as instructions to said controllers, wherein the system further comprises sensors and means for obtaining process values, such as downhole pressure, temperature and torque, wherein the system is adapted to, continuously and/or repeatedly, calculate safeguard envelopes for performance process parameters on the basis of process values and drilling process models and that it is adapted to restrain said controllers from applying performance process parameters outside said safeguard envelopes as a result of driller instructions, and—a method and system for automatically triggering a remedying action in case of an evolving or existing critical situation, comprising calculation of process parameter boundaries which represent a critical condition for the well by using calibrated drilling process models, comprising (i) triggering an emergency action if a parameter exceeds said boundaries, said emergency action being intended to minimize the effect of said critical situation, (ii) then further analyzing the well in order to determine which remedying action to then be applied, the remedying action being intended to remedy the cause of said effect; (iii) if said remedying action is not capable of remedying the cause of said effect, then applying predetermined safe process parameters or shutting down.

21 Claims, 5 Drawing Sheets

(56) References Cited

U.S. PATENT DOCUMENTS

| | | | | |
|---|---|---|---|---|
| 4,903,245 | A * | 2/1990 | Close et al. | 340/853.3 |
| 5,651,783 | A | 7/1997 | Reynard | |
| 5,842,149 | A | 11/1998 | Harrell et al. | |
| 6,021,377 | A * | 2/2000 | Dubinsky et al. | 702/9 |
| 6,109,368 | A | 8/2000 | Goldman et al. | |
| 6,148,912 | A * | 11/2000 | Ward | 166/250.07 |
| 6,152,246 | A | 11/2000 | King et al. | |
| 6,192,980 | B1 | 2/2001 | Tubel et al. | |
| 6,206,108 | B1 | 3/2001 | MacDonald et al. | |
| 6,233,524 | B1 | 5/2001 | Harrell et al. | |
| 6,237,404 | B1 | 5/2001 | Crary et al. | |
| 6,256,603 | B1 | 7/2001 | Celniker | |
| 6,408,953 | B1 | 6/2002 | Goldman et al. | |
| 6,527,062 | B2 * | 3/2003 | Elkins et al. | 175/25 |
| 6,612,382 | B2 | 9/2003 | King et al. | |
| 6,662,110 | B1 | 12/2003 | Bargach et al. | |
| 6,732,052 | B2 | 5/2004 | MacDonald et al. | |
| 6,766,254 | B1 | 7/2004 | Bradford | |
| 6,820,702 | B2 | 11/2004 | Niedermayr et al. | |
| 6,868,920 | B2 | 3/2005 | Hoteit et al. | |
| 6,918,454 | B2 | 7/2005 | Prior et al. | |
| 6,944,547 | B2 | 9/2005 | Womer et al. | |
| 6,968,909 | B2 | 11/2005 | Aldred et al. | |
| 7,003,439 | B2 | 2/2006 | Aldred | |
| 7,032,689 | B2 | 4/2006 | Goldman et al. | |
| 7,085,696 | B2 | 8/2006 | King | |
| 7,114,579 | B2 | 10/2006 | Hutchinson | |
| 7,128,167 | B2 | 10/2006 | Dunlop et al. | |
| 7,142,986 | B2 | 11/2006 | Moran | |
| 7,158,886 | B2 | 1/2007 | Hou et al. | |
| 7,172,037 | B2 | 2/2007 | Dashevskiy et al. | |
| 7,357,196 | B2 | 4/2008 | Goldman et al. | |
| 7,422,076 | B2 | 9/2008 | Koedentz et al. | |
| 7,730,967 | B2 | 6/2010 | Ballantyne et al. | |
| RE42,877 | E * | 11/2011 | Lirette et al. | 166/285 |
| 2002/0011333 | A1 * | 1/2002 | Ward | 166/250.07 |
| 2002/0013630 | A1 | 1/2002 | Siemers | |
| 2002/0108783 | A1 * | 8/2002 | Elkins et al. | 175/25 |
| 2002/0148610 | A1 * | 10/2002 | Bussear et al. | 166/278 |
| 2003/0106693 | A1 * | 6/2003 | Jennings et al. | 166/345 |
| 2004/0221997 | A1 * | 11/2004 | Giroux et al. | 166/380 |
| 2005/0087367 | A1 * | 4/2005 | Hutchinson | 175/45 |
| 2005/0269079 | A1 * | 12/2005 | Franklin | 166/250.07 |
| 2007/0185696 | A1 | 8/2007 | Moran | |
| 2009/0095527 | A1 * | 4/2009 | Lane et al. | 175/25 |
| 2010/0089574 | A1 * | 4/2010 | Wideman et al. | 166/272.1 |
| 2010/0089576 | A1 * | 4/2010 | Wideman et al. | 166/272.6 |
| 2010/0133009 | A1 * | 6/2010 | Carlson et al. | 175/45 |
| 2011/0247878 | A1 * | 10/2011 | Rasheed | 175/50 |

FOREIGN PATENT DOCUMENTS

| | | |
|---|---|---|
| SU | 1086134 | 4/1984 |
| SU | 1231946 | 11/1995 |

OTHER PUBLICATIONS

Iversen et al. "Demonstrating a New System for Integrated Drilling Control", 2007 AADE National Technical Conference and Exhibition, Apr. 10-12, 2007.

Fossgaard et al. "Method for Optimal Placement of Sensors in a Wired Pipe Drillstring", 2007 IADC/SPE Managed Pressure Drilling and Underbalanced Operations Conference and Exhibition, Mar. 28, 29, 2007.

Iversen et al. "Offshore Field Test of a New Integrated System for Real-Time Optimization of the Drilling Process", 2008 IADC/SPE Drilling Conference, Mar. 4-6, 2008.

Cayeux et al. "Real-Time Optimization of the Drilling Process—Challenges in Industrialization", SPE/IADC Drilling Conference and Exhibition, Mar. 17-19, 2009.

Cayeux et al. "Early Detection of Drilling Conditions Deterioration Using Real-Time Calibration of Computer Models: Field Example from North Sea Drilling Operations", SPE/IADC Drilling Conference and Exhibition, Mar. 17-19, 2009.

Cayeux et al. "Automation of Mud-Pump Management: Application to Drilling Operations in the North Sea", 2010 IADC/SPE Drilling Conference and Exhibition, Feb. 2-4, 2010.

Cayeux et al. "Automation of Drawworks and Topdrive Management to Minimize Swab/Surge and Poor-Downhole-Condition Effects", 2010 IADC/SPE Drilling Conference and Exhibition, Feb. 2-4, 2010.

Florence et al. "Realtime Models for Drilling Process Automation: Equations and Applications", 2010 IADC/SPE Drilling Conference and Exhibition, Feb. 2-4, 2019.

Kyllingstad "New Possibilities for Drilling Machinery Using Computer Controlled Machinery", RF/EXXON Seminar, Apr. 6-7, 1992.

Methods for Cost Optimised Drilling Dissertation by Thor Syvert Froitland Published by Hogskolen i Stavanger, 1995; vols. 12—1995 of Skrifter.

Iversen et al. "Monitoring and Control of Drilling Utilizing Continuously Updated Process Models", IADC/SPE Drilling Conference, Feb. 21-23, 2006.

Rommetveit et al. "Drilltronics: An Integrated System for Real-Time Optimization of the Drilling Process", IADC/SPE Drilling Conference, Mar. 2-4, 2004.

Carlsen et al. "Performing the Dynamic Shut-In Procedure Because of a Kick Indicent When Using Automatic Coordinated Control of Pump Rates and Choke-Valve Opening", SPE/IADC Managed Pressure Drilling and Underbalanced Operations Conference and Exhibition, Jan. 28-29, 2008.

Li et al. "An Iterative Ensemble Kalman Filter for Data Assimilation", SPE Annual Technical Conference and Exhibition, Nov. 11-14, 2007, p. 1.

* cited by examiner

DRILLING CONTROL METHOD AND SYSTEM

This application is entitled to the benefit of, and incorporates by reference essential subject matter disclosed in PCT Application No. PCT/NO2010/000081 filed on Mar. 1, 2010, which claims priority to Norway Application No. 20090935 filed Mar. 2, 2009.

BACKGROUND OF THE INVENTION

1. Technical Field

The present invention relates to drilling of hydrocarbon wells. In particular, the invention relates to a method and a drilling control system for providing risk reduction and improved efficiency of a drilling process.

2. Background Information

When drilling a hydrocarbon well, such as a subsea well, it is known to operate the drilling equipment through a computerized drilling system. The drilling operator controls the various parameters of the process using control devices such as joysticks, throttles or switches. The control devices are connected to equipment controls, such as a controller for the rotary table.

When drilling such a well, one wishes to drill the well as efficiently as possible, with regards to time, cost and safety, while at the same time avoiding doing any damage to the formation being drilled, which may contain producible gas and oil reservoirs. To achieve this one must adapt the drilling process to drilling of the well in question. This has been the case for the history of drilling of oil and gas wells.

Systems are known which monitor drilling control parameters in order to prevent damage to the drilling equipment, for instance to the drill bit or tubular (drill string, casing or liner). Such control parameters can include drill string velocity, drill string torque, drill string RPM, hook load, WOB, pump flow rate, and choke opening and choke pump flow rate. They may automatically generate an alarm if a critical situation is detected.

The challenges in controlling the drilling process are not new, but drilling of oil and gas wells is becoming more and more of a challenge. Known reservoirs are being depleted, leading to problems with both formation stability and narrowing pressure windows. Expanding areas of exploration and production, including increasing activities in arctic and deep sea/deep reservoir areas, are generating new demands on safety and accuracy of drilling process control.

Patent publication U.S. Pat. No. 7,172,037 (Baker Huges Inc.) describes a system for optimizing a drilling process by providing optimized parameters to the driller or drilling control system. Patent publication U.S. Pat. No. 6,662,110 also regards a system for optimization of a drilling process as well as for protection of well drilling systems.

Patent publication U.S. Pat. No. 6,968,909 (Schlumberger) describes a downhole drilling system that is based on running scripts for various drilling steps and drilling conditions. For instance, a tripping script is run for tripping of the drill string. Thus, with this system, the drilling is performed on "autopilot", for as long as the system recognizes what is taking place ("diagnostic" (316) and "manual control" (320) in FIG. 3).

This automated system collects downhole and surface measurements to continually update drilling process models and to calculate optimized drilling parameters as well as operating limits. In addition, it contains automated analysis of the drilling conditions, which can result in running of a remedying script if an undesired condition is detected.

It is, however, desirable to perform drilling operations manually, in the sense of controlling the drilling equipment, such as the top drive/the rotary table, mud pumps, and the winch drive (drawworks) with suitable interface means, such as a joystick, without the risk of damaging the well due to human error. The present invention provides a novel solution to this task.

Furthermore, current systems for optimization of drilling parameters work independently, individually controlling one parameter or a set of parameters to enable optimization with respect to a particular mechanism. Full optimization with respect to individual mechanisms may be detrimental to other process mechanisms. As an example, fully optimized rate of penetration with respect to specific mechanical energy, through adjustment of WOB and RPM may lead to cuttings build-up issues if the pump rate is not adjusted accordingly, which is further constrained by the existing formation geopressures. Intelligent coordination between different input to optimization and given constraints is desirable to ensure that the overall process is optimal.

A new methodology has been developed to fulfil the requirements described above. The overall objective of this method is to maintain the functioning of the drilling machinery within safeguards accounting for both the machine limitations but also the wellbore limits. In addition, automatic triggering of corrective actions can assist in maintaining the well integrity in case of abnormal situations.

The goal of this methodology is not to completely automate part or the whole of the drilling process, but to apply continuously updated envelopes of protection. Therefore the operator has the freedom to operate the drilling machinery as he wishes, while he is given assistance in maintaining the drilling conditions within safe boundaries. This methodology is solely used by the drilling machinery operators.

The methodology provides direct machine control but can also provide early problem detection during the drilling process, so that the operator can decide on corrective actions, or alternatively trigger automatic actions in case of emergency to take advantage of the rapidity of computer controlled machine steering.

When determining preferable drilling control parameters today, such as ROP, WOB, applied drillstring torque and drilling fluid circulation rate, one takes into account such properties as the dimensions of the well, formation properties (e.g. stresses, geopressures, geothermal), the drillstring (e.g. bit type, material properties of string elements) and the drilling fluid (e.g. density, rheology). For updating of optimal parameters, analysis of well behavior during drilling of the well may be performed, where available data from sensors on the rig and downhole are applied, possibly together with results from active testing of the well. From such analysis permissible operational windows and process constraints may also be determined Such analysis is normally performed independently of the drilling operation on the rig.

Process constraints comprise machine limits, material limits and wellbore/formation limits Machine limits (e.g. maximum power of draw works engines) and material limits (e.g. maximum torque on drill string elements) are provided by the suppliers of the drilling machinery. Wellbore and formation limits may be determined by analysis of historical data from offset wells and survey data, and by active testing of the well (e.g. Leak Off Test/Formation Integrity Test to determine upper pressure bound). Such active tests are performed by the drilling crew on the rig.

Since all decision making is done by the operator based on availability of information, there will always be a time delay before any action is taken when undesired symptoms are observed. During this delay there is a great risk of the observed problem escalating and becoming more severe (e.g. pressure buildup).

Unexpected behavior occurring during drilling operations is today detected by the drilling crew with the aid of alarms. It is the drilling crew's task to interpret behavior and take appropriate mediating measures. The reaction taken depends on the experience of the crew, and various procedures may be used for the same type of incident. This is one of the major challenges of today's drilling process. The full know-how of the organization is not applied, and inappropriate mediating actions may cause loss of time, loss of production, and possibly loss of the well. Thus, as will appear from the description below, an advantageous embodiment of the invention comprises means for rapid remedial action.

SUMMARY OF THE DISCLOSURE

According to a first aspect of the invention there is provided a method of drilling an oil or gas well, wherein performance process control parameters are controlled through machine controllers, wherein a driller drills a well by controlling said process control parameters through said machine controllers with driller instructions, and wherein process values are provided, for instance measured, and continuously of repeatedly input to a safeguard calculation unit. According to the invention the method comprises the following steps: (a) with the safeguard calculation unit, continuously or repeatedly calculate safeguard limits for process control parameters, derived from process limits, such that at least some of said safeguard limits constitute boundary values of performance process parameter-related safeguard envelopes; (b) restricting controller output to remain within said safeguard envelopes, as said controllers are adapted to keep said controller output within said safeguard envelopes, thereby preventing driller instructions to result in performance process parameters exceeding said safeguard envelopes.

The said safeguard calculation unit comprises continuously calibrated drilling process models, which enable calculation of safeguards limits for said performance process control parameters, the calculation being based on for instance wellbore pressure limits and mechanical tubular limits as constraints, as well as current process values. The said safeguard calculations are performed by iterative calculations until the safeguard limits converge, for instance with respect to (or align with) the wellbore pressure limits and mechanical tubular limits.

In the simplest application, step (c) involves using an iterative zero point solver applying forward calculations of the hydraulics model for calculating acceleration, deceleration and velocity limits for pipe movement (with geopressures applied as constraints).

In a preferred embodiment, the method according to the first aspect of the invention is characterized in that values and/or parameters are provided by application of one or more of the following systems: i) a drilling machinery data acquisition system, which is an integrated part of a machine control system and which is adapted to provide control system values, such as for instance standpipe pressure, active volume, block velocity, block position, hook load, bit depth, ROP, RPM, pipe torque, drilling fluid pit temperature, and drilling fluid pit density; ii) a mud logging system, which may consist of manual or automatic fluid sampling and analysis providing such measurements as drilling fluid rheology, composition, temperature and density; and iii) a downhole measurement data acquisition system, comprising downhole sensor tools for providing downhole measurements, such as downhole pressure, downhole temperature and survey measurements. The rate and quality of these measurements can differ depending on the type of sensor and the mode of transmission of the measurements. Therefore there is a need to integrate the different sources, apply necessary corrections and quality control procedures before making use of the measurements in further calculations.

In another preferred embodiment of the method according to the first aspect of the invention, it comprises storing and communicating data, wherein provided data is stored in a data repository, such as a database, and at least some of said data is being quality controlled, and wherein at least some of said data is being used for calibration of said drilling process models for application in safeguarding and diagnostics. For ease of communication such a data repository may apply open standards of data communication such as OPC or WITSML. The data repository may also store set-points defining behavior of machine controllers.

The method may also involve applying automated data quality control through filtering applications, such as FIR/MR filtering and automatic high pass coefficient distribution analysis, allowing for smoothing and detection of outliers (or invalid measurements).

Furthermore, the method can be characterized in that calibration of drilling process models of the drilling process (e.g. drill-string mechanic, drilling fluid hydraulic, heat transfer and rock mechanic) are used to calculate the envelope of protection to maneuver the drilling machinery. Some inputs used by such models are uncertain or not well known. It is therefore necessary to estimate those parameters using real-time measurements within a calibration process. The objective is to achieve a global calibration of the physical models for the remaining of the drilling operation. At start, the parameters requiring calibration are uncertain and therefore the quality of the results predicted by the physical models is at its lowest. With time, acquired measurements help reduce the uncertainty on the physical parameters being calibrated and therefore the accuracy of the calculations made with the physical models increases. In another embodiment of the method according to said first aspect, the method involves calibrating drilling process models, wherein for the calibration of hydraulics models, fluid flow friction factor calibration is performed by using unscented Kalman filtering or steady state model with zero point solver, wherein measured standpipe pressure and downhole pressure are applied for calibration.

It is also possible to calibrate the drilling process models in such way that for the calibration of torque and drag model, drill string sliding/rotating friction is estimated by using back calculation with a zero point solver, applying measured hook load and torque for model tuning.

The method may also comprise continuously applying tubing/drill string velocity safeguards during running and pulling of a tubular, wherein i) iterative calculation of drill string velocity, acceleration and/or deceleration limits is performed by forward calculations using calibrated hydraulics model from current process values, bounds given by pressure limits (PP or FP) in open hole section, and zero point solver; and wherein ii) drill string velocity acceleration and/or deceleration limits are enforced through machine controllers.

Also, the method according to the first aspect of the invention may involve performing continuous application of tubular mechanical safeguards during movement of such, such as maximum overpull/setdown weight and rotating torque, wherein i) bounds are given by elastic limits constraints and direct calculation of limits is performed using current configuration of wellbore trajectory and tubular length; and wherein ii) tubular mechanical limits are enforced through machine controllers.

In an additional embodiment, the method comprises the steps of i) continuously or repeatedly predicting future process values on the basis of at least drilling process models and past or current process values; ii) in that future, comparing predicted process values with current process values, as measured or otherwise provided; and then iii) if current process values deviate outside predetermined allowed deviation values, input remedying instructions to said controllers in order to provide remedying performance process parameter from said controllers.

According to a second aspect of the present invention, there is provided a drilling control system comprising a plurality of controllers adapted to control performance process parameters, on the basis of driller controls from a driller that provides this as instructions to said controllers, wherein the system further comprises sensors and means for obtaining process values, such as downhole pressure, temperature and torque. The system is adapted to, continuously and/or repeatedly, calculate safeguard envelopes for performance process parameters on the basis of process values and drilling process models and that it is adapted to restrain said controllers from applying performance process parameters outside said safeguard envelopes as a result of driller instructions.

Preferably, the system according to the second aspect of the present invention is characterized in that i) machine controller algorithms for application of derived safeguards are implemented directly in the machine controllers; ii) the behavior of these machine controller algorithms is uniquely defined through setpoints or curves; iii) calculated setpoints or curves defining safeguards, are communicated to the machine controllers from the safeguard calculation units through a central data repository; iv) the commands given by the operator are constantly compared to the continuously updated envelopes of protection of the drilling machinery. If these commands are within the safeguards they are used directly to control the drilling machines. However, if the commands are outside the acceptable limits of both the well and the capability of the drilling machinery, the safest condition is applied.

According to a third aspect of the present invention, there is provided a method for automatically triggering a remedying action in case of an evolving or existing critical situation, comprising calculation of process parameter boundaries which represent a critical condition for the well by using calibrated drilling process models. The method comprises (i) triggering an emergency action if a parameter exceeds said boundaries, said emergency action being intended to minimize the effect of said critical situation, (ii) then further analyzing the well in order to determine which remedying action to then be applied, the remedying action being intended to remedy the cause of said effect; (iii) if said remedying action is not capable of remedying the cause of said effect, then applying predetermined safe process parameters or shutting down.

In an embodiment of the third aspect of the present invention, the method is applied for detection of packoff/bridging, wherein (a) limits for detecting indication of packoff or bridging are detected by rapid buildup of pump pressure; and steady increase/erratic torque behavior; wherein detection is achieved by comparing predicted values, by using models, to actual behavior; (b) limits for triggering automated action with respect to pump pressure and torque behavior are calculated as a function of fluid flowrate, pipe torque and RPM; (c) immediate automatic action comprises a predefined %-wise reduction of flowrate; (d) if packoff is diagnosed due to continuously increasing pump pressure/torque or sustained erratic torque, automatic shutdown of pumps is performed; (e) if bridging is diagnosed by resulting stabilized torque variations/pump pressure, then flowrate is automatically increased to maximum allowable flowrate as a function of bridge, as defined by remediating algorithms with calculated input parameters.

According to a fourth aspect of the present invention, there is provided a system for calculation of the acceptable threshold conditions before determining that the well has entered a critical situation. The system is adapted to apply the calibrated drilling process models in said calculation, wherein, in case a parameter is exceeding the continuously updated conditions for a critical situation, an automatic action is triggered automatically to minimize the effect of the critical situation. This automatic action can adapt itself as a function of the response of the well to the automatic action. Preferably, this system is further characterized in that i) machine controller algorithms for automatic triggering of remediating action are implemented directly in the machine controllers; ii) machine controller algorithms for dynamic remediating action are implemented directly in the machine controllers; iii) calculated setpoints/curves/surfaces defining triggering and dynamic remediating action are communicated to the machine controllers from the calculations through a central data repository; iv) the measured process values are continuously compared with the triggering limits, and wherein, if triggering limits are exceeded then remediating action is automatically triggered; v) after triggering, further remediating control is performed dynamically as a function of response, as defined by the setpoints/curves/surfaces defining appropriate dynamic remediating action.

According to the present invention, one may also imagine using the same methods and systems for calculating a window of efficiency; that is, using the same methodology for keeping the process within a preferred operational window. Thus, one may use the same set-up for the window of efficiency as is used for said safeguard limits or safeguard windows.

The term performance process parameter defines a parameter or value which can be controlled or changed by the driller by appropriate instructions to or control of the drilling equipment. Such parameters can include values for WOB (weight on bit), drillpipe, RPM (rotations per minute), and drilling fluid flowrate.

A driller should be conceived as a person who manually controls the drilling process by giving driller instructions with suitable interface means, such as joysticks, throttles or switches. Hence, driller instructions are instructions for performance process parameters.

Furthermore, a controller is a device that controls engines or other actuators, such as the engine for the rotary table/top drive, drawworks or the pump for the mud flow. A controller can thus control an engine on the basis of driller instructions, however while being operated by software or software-corresponding hardware, such as a logic electrical circuit.

Process values are various characteristics related to the drilling and the drilled well, such as ROP (rate of penetration), temperatures, pressure, cuttings concentration, and drill string torque.

Control system values are values that are directly generated in the surface drilling control system (DCS) through the DCS instrumentation (as opposed to measured values downhole).

The safeguards limits are limits within which performance parameters are to be kept.

Drilling process models are models used to simulate a drilling process. Some of the most important models are hydraulics model (pressure, density, multiphase flow), temperature model, mechanics model (torque and drag, string/pipe forces, torque). Furthermore, there are earth models, comprising formation layering model, formation stresses/geopressures model, and geothermal models. In addition there are wellbore models, comprising wellbore stability model and trajectory model.

BRIEF DESCRIPTION OF THE DRAWINGS

In order to give a more thorough understanding of the various features of the present invention, a detailed description of an example embodiment is given in the following with reference to the drawings, in which.

DETAILED DESCRIPTION OF THE INVENTION

Figure 1:
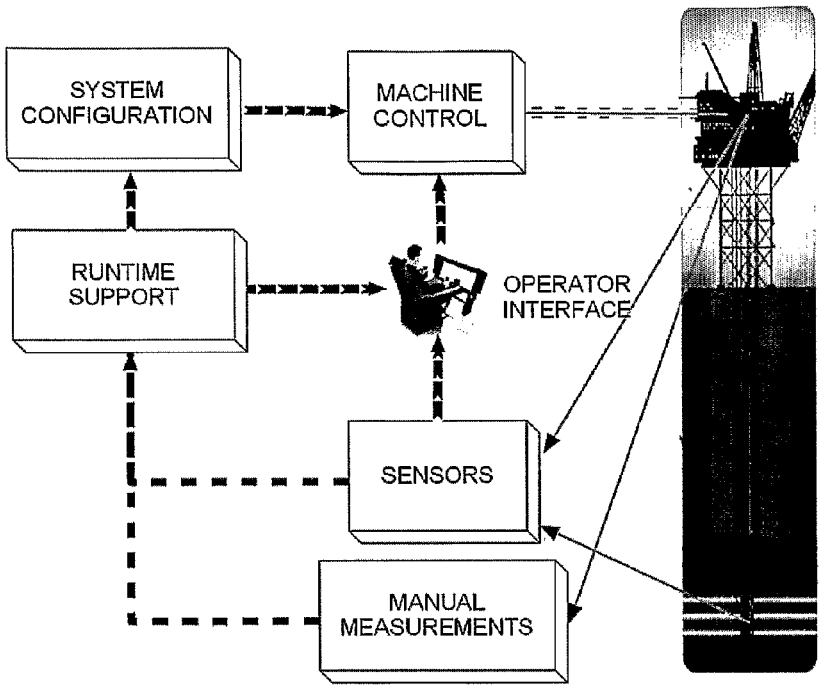
Fig. 1 (prior art)
FIG. 1 is an illustration of a prior art system for drilling process control.

FIG. 1 illustrates a known set-up for a drilling process. For drilling of oil and gas wells, such a drilling control system (DCS) can be used on the drilling rig. A DCS of the prior art may consist of sensors for measuring drilling parameters, computer controlled drilling machinery with computer aided machine control, and a human operator interface. The objective of such a system is to aid the driller (or operator) in controlling drilling process parameters, such as velocity of the drill string when running in and out of the borehole, or wellbore fluid flowrate, through application of software control algorithms embedded in the machine control.

In addition to the manual control of parameters performed by the operator or driller in FIG. 1, there may be manually tunable parameters in the MACHINE CONTROL, such as constant WOB or ROP settings which may be automatically enforced by the system through application of process control during drilling operations, though application of machine control algorithms. However, there can also be automated dynamic control of control parameters. To avoid damage to the drilling machinery, limits with regards to machinery operational parameters, may be automatically enforced through drilling control system algorithms. Such parameters would be set through "system configuration" in FIG. 1.

Furthermore, the "runtime support"-unit in FIG. 1 provides analysis of measured data, providing feedback to the driller for process control optimization, e.g. values for WOB and pipe revolution frequency to achieve optimal drilling rate of penetration (ROP), or maximum allowable pump-rate given the existing well pressure boundaries and mud properties. To provide update of necessary information for such analysis, "manual measurements" may be performed, such as measurements of mud properties performed by the mud engineer on the rig. Input from support personnel is also communicated to the driller.

In order for the machine control algorithms to function properly, initial configuration of process properties, such as drillpipe section lengths, and setting of control parameters, such as ROP or WOB are performed with the "system configuration"-unit prior to drilling operations. Such settings may of course also be updated during operations, based on analysis of process behavior, provided by runtime support.

Figure 2:
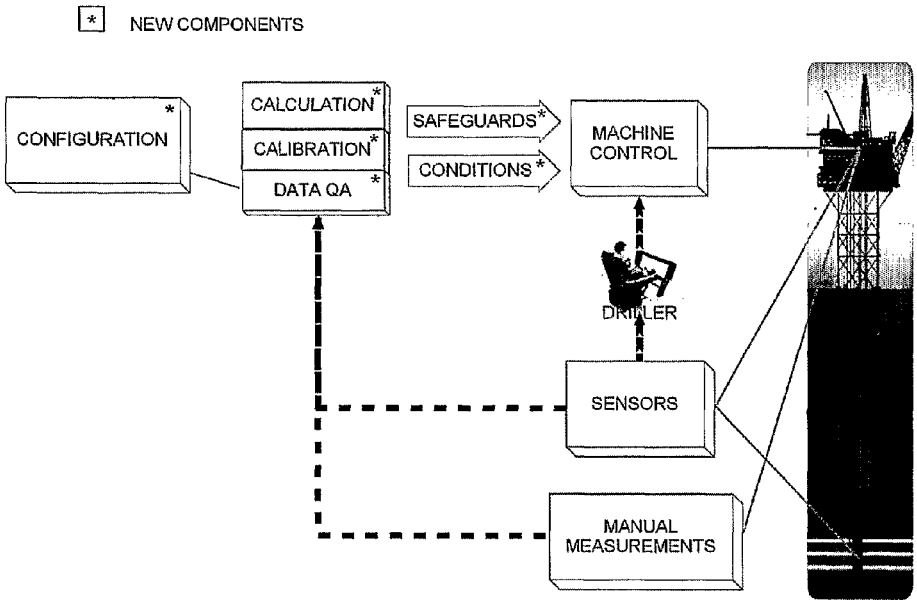
FIG. 2 is a schematic illustration of a set-up according to the present invention.

Having described some essential features of a prior art set-up, reference is now made to FIG. 2, illustrating an embodiment of the present invention. Before going into detailed examples (further below), an overview of the main features and possibilities is given.

The main principle of this set-up is to use physical models of the drilling process to update continuously acceptable safeguards and conditions for triggering emergency procedures.

The system can be decomposed in the following steps:

1. Acquire data and perform a quality assurance (QA) of the measurements
2. Calibrate the physical models
3. Calculate the safeguards and critical conditions for abnormal situations
4. Steer the drilling machinery within an envelope of protection
5. Warn the operator of downhole condition deterioration
6. Trigger automatic actions in case an unexpected event has been recognized.

Preferably, the data for such a system is provided by three different systems:

A drilling machinery data acquisition system

A mud logging unit

A downhole measurement data acquisition system

The rate and quality of these measurements can differ depending on the type of sensor and the mode of transmission of the measurements. Therefore the different sources are integrated and necessary corrections are performed, as well as quality control procedures, before making use of the measurement in further calculations.

The various physical models of the drilling process (such as drill-string mechanic, drilling fluid hydraulic, heat transfer and rock mechanic) are used to calculate the envelope of protection to maneuver the drilling machinery. Some inputs used by such models are uncertain or not well known. It is therefore necessary to estimate those parameters using real-time measurements within a calibration process. The objective is to achieve a global calibration of the physical models for the remaining of the drilling operation. At start, the parameters requiring calibration are uncertain and therefore the quality of the results predicted by the physical models is at its lowest. With time, acquired measurements help reducing the uncertainty on the physical parameters being calibrated and therefore the accuracy of the calculations made with the physical models is increasing.

Using the calibrated physical models, calculation of envelopes of protection of the drilling machinery in function of the different type of drilling operations (tripping, reaming, drilling, circulation, etc) is performed. Preferably, one also calculates the maximum acceptable conditions before considering that the well has entered a critical situation.

The commands given by the operator are constantly compared to the continuously updated envelopes of protection of the drilling machinery. If this command is within the safeguards it is used directly to control the drilling machines. However, if the command is outside the acceptable limits of both the well and the capability of the drilling machinery, the safest condition is applied. Thus, the driller is indeed controlling the machinery manually (i.e. through appropriate interface means), but the well and machinery are protected from overloading. During the drilling process, the evolution of drilling parameters is continuously monitored and compared with predictions made by the calibrated physical models.

Discrepancies between the measurements and the forecasts may be indication of downhole condition deterioration. Forward simulations made with the current conditions are used to check if the current section can be drilled safely. If it is still possible to drill to end of the section, warnings are raised to signal the operator of the potential problem. However, if it will not be possible to reach the end of the section, an alarm is generated to inform the operator that corrective actions need to be run in order to cure the problem. In this way, the system takes advantage of the experience and the analytic capabilities of the driller in such a challenging situation, while still keeping the equipment and the well safe from damage.

In case a parameter is exceeding the continuously updated conditions for an unexpected situation, an automatic action is triggered automatically to minimize the effect of, and possibly remedy the critical situation. This automatic action can adapt itself as a function of the response of the well to the procedure.

Figure 3:
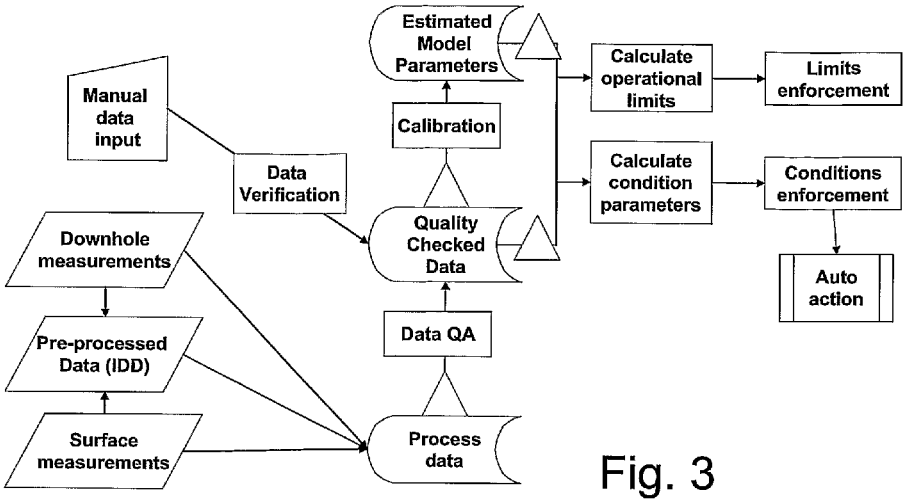
FIG. 3 is a schematic diagram illustrating the flow of information in a system according to the one shown in FIG. 2.

FIG. 3 is a schematic diagram illustrating the flow of information in a system according to the one shown in FIG. 2.

Having described the main features of the embodiment shown in FIG. 2 in a general manner, reference is now made to FIG. 4, and a more tangible example of use will be given.

Figure 4:
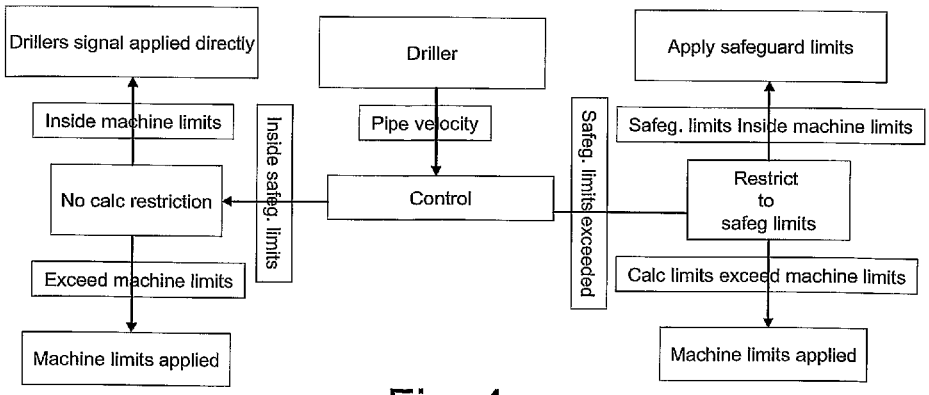
FIG. 4 is a schematic diagram illustrating an example of tripping/reaming control.

FIG. 4 illustrates the use of a tripping safeguarding unit which calculates maximum acceleration, velocity and deceleration of the drill string. The safeguarding ensures that the downhole pressure window is not exceeded as a result of pipe movement. With application of models in safeguarding, downhole pressure is known with high accuracy at all times, ensuring good control. If the driller (i.e. the driller signal) remains within the safeguard envelope, the left hand side of the diagram of FIG. 4 will apply. The driller then freely instructs the machinery within the safeguard envelope. However, should the driller give instructions that extend beyond machine limits, the machine limits will be applied and restrict the driller's instructions (see lower left box of FIG. 4).

On the other hand, if the driller moves outside the safeguard envelope, his control signal is limited to the safeguard limit. Also, if this safeguard limit is outside machine limits, the machine limit is applied.

Figure 5:
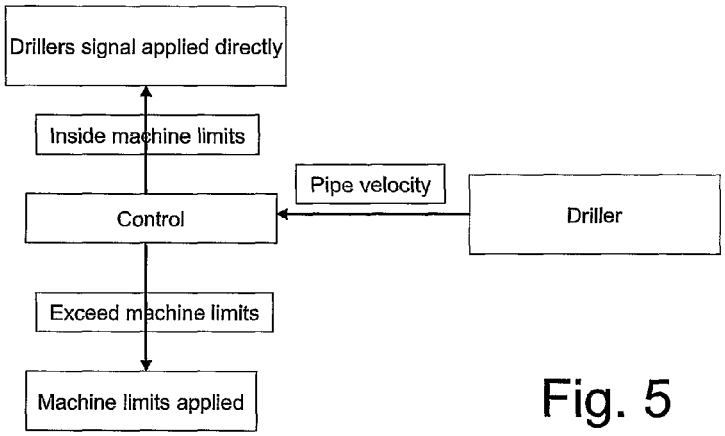
FIG. 5 is a schematic diagram illustrating tripping/reaming without safeguarding.

FIG. 5 illustrates an embodiment without safeguarding. In this embodiment only the drilling machinery is protected by the system. In this embodiment the driller must himself ensure that the downhole pressure is within the available operating window, while performing a tripping operation. Thus, if the driller remains within the machine limits, his signal will be applied directly. If he moves outside the machine limits, the limits will be applied instead of his signal.

Figure 6:
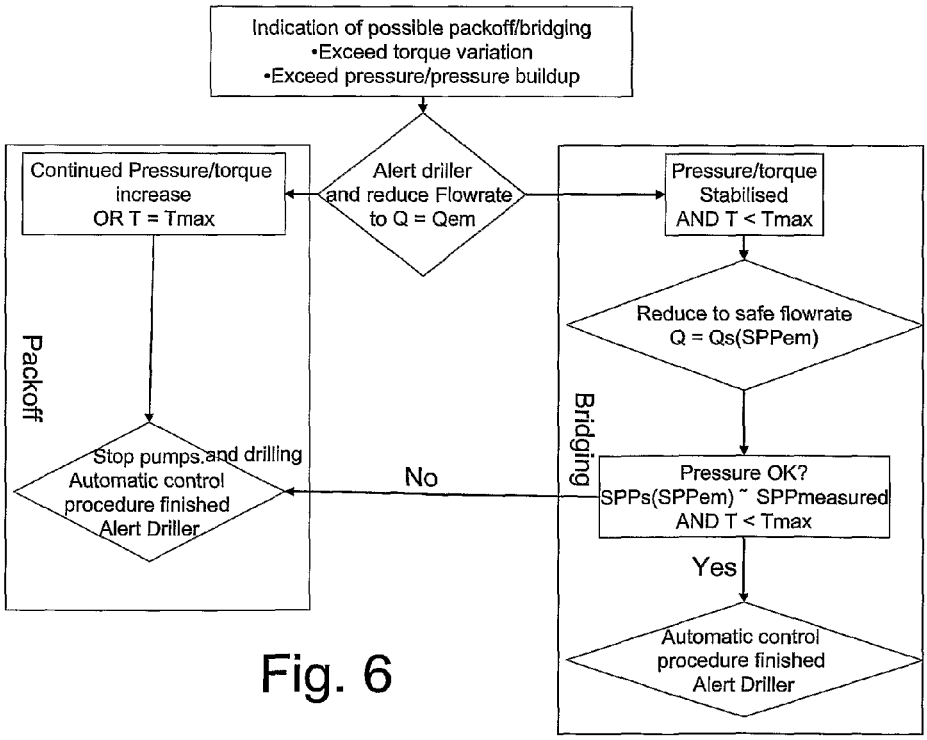
FIG. 6 is a schematic diagram illustrating an automatic stuck pipe action.

FIG. 6 shows the set-up for an automatic mediating action on detection of pack-off or bridging. If indication of possible pack-off/bridging is measured, the driller is alerted and the flowrate (Q) is reduced to a reduced (emergency) flowrate (Qem). The Qem can for instance be 80% of the maximum circulation rate. T and Tmax are the torque and the maximum torque of the drill string, respectively. Tmax is calculated on the basis of mechanical models, and depends on the position of the drill string, its characteristics, hole configuration, circulation rate, etc. In case of bridging (right hand side of FIG. 6), the flow rate is reduced to safe flowrate (Qs). If the situation stabilizes the driller is alerted and the automated control procedure is finished. If not, the pumps are stopped (left hand side of FIG. 6). Also, in case of pack-off (left hand side), the pumps are stopped and the driller is alerted, see FIG. 6. Also in case of pack-off, the drilling is interrupted and the pumps are stopped. In FIG. 6, the abbreviations have the following meanings:

Qem—Emergency flowrate (e.g. 80%)

Tmax—Maximum torque (calculated based on makeup/yield)

SPPem—emergency standpipe pressure (standpipe pressure with emergency flowrate)

Qs(SPPem)—Safe flowrate (which is a function of extent of bridge (narrowing of annulus) which is derived from emergency standpipe pressure SPPem using hydraulics model)

SPPs—Safe standpipe pressure (calculated using hydraulics model—function of extent of bridge derived from emergency standpipe pressure)

SPPmeasured—measured standpipe pressure

Figure 7:
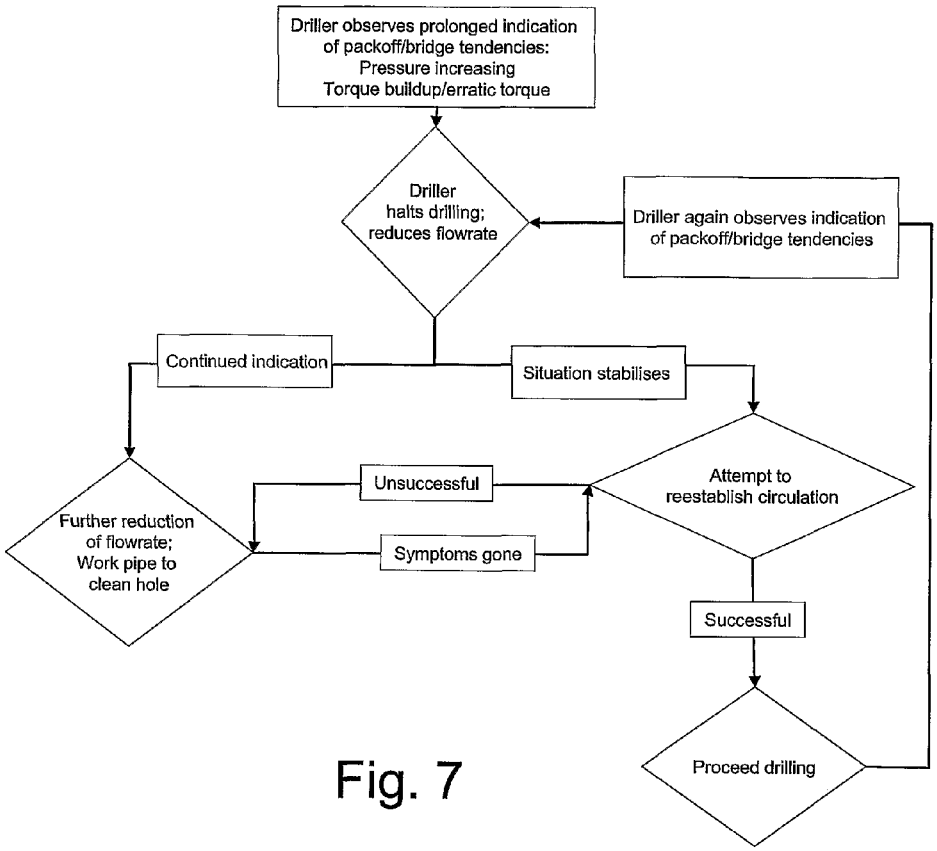
FIG. 7 is a flow chart for manual pack-off or bridging prevention.

FIG. 7 illustrates a flow chart for manual pack-off or bridging prevention.

With the present invention several advantages are obtained. For instance, by the application of calibrated models, continuously updated operational parameter windows are available. The parameter windows are updated faster than what is possible with remote support, and also much more accurate than planned limits, since the updated limits are based on real values, not foreseen or predicted values.

The possibility to drill directly, i.e. to control the machinery directly through interface means such as joysticks and switches, with the safeguarding function to account for excessive drilling instructions, makes it possible to take advantage of human knowledge and experience while still not risking damage to the equipment or formation.

Due to the more accurately calculated parameter windows, tripping or reaming operations can be performed faster, thereby saving valuable time and hence costs. Also, the demand on the driller to detect emerging critical situations and react accordingly is reduced, since the system will monitor such conditions automatically.

Although this invention has been shown and described with respect to the detailed embodiments thereof, it will be understood by those skilled in the art that various changes in form and detail thereof may be made without departing from the spirit and the scope of the invention.

What is claimed is:

1. A drilling control method for automatically triggering a remedying action responsive to an evolving or existing critical condition, the method comprising the steps of:

(i) calculating process parameter boundaries which represent a critical condition for a well by using calibrated drilling process models, (ii) triggering an emergency action if a process parameter exceeds said process parameter boundaries, said emergency action being intended to minimize the effect of said critical condition, (iii) then further analyzing the well in order to determine a remedying action to then be applied, the remedying action being intended to remedy the cause of said critical condition, the remedying action being determined dynamically as a function of the response of the well to the remedying action;

(iv) if said remedying action is not capable of remedying the cause of said critical condition, then applying predetermined safe process parameters or shutting down.

2. The drilling control method according to claim 1 where the critical condition is packoff, wherein (a) packoff is detected based on one or more of rapid build up of pump pressure or steady increase in torque or erratic torque behavior, wherein detection is achieved by comparing predicted values, by using models, to actual behavior; and (b) the process parameter boundaries for triggering emergency action with respect to pump pressure and torque behavior are calculated as a function of fluid flowrate, pipe torque and rpm; and (c) immediate emergency action comprises a predefined %-wise reduction of flowrate; and (d) if packoff is diagnosed based on one or more of rapid build up of pump pressure or steady increase in torque or erratic torque behavior, automatic shutdown of pumps is performed.

3. The drilling control method according to claim 1 where the critical condition is bridging, wherein (a) bridging is detected based on one or more of rapid build up of pump pressure or steady increase in torque or erratic torque behavior, wherein detection is achieved by comparing predicted values, by using models, to actual behavior; and (b) the process parameter boundaries for triggering emergency action with respect to pump pressure and torque behavior are calculated as a function of fluid flowrate, pipe torque and rpm; and (c) immediate emergency action comprises a predefined %-wise reduction of flowrate; and (d) if bridging is diagnosed based on one or more of rapid build up of pump pressure or steady increase in torque or erratic torque behavior, then flowrate is automatically increased to a maximum allowable flowrate as a function of bridge, as defined by remediating algorithms with calculated input parameters.

4. The method as claimed in claim 1, where calculating process parameter boundaries which represent a critical condition for the well uses calibrated drilling process models and current or past process values.

5. The method as claimed in claim 1, further comprising determining the emergency action using calibrated drilling process models and current or past process values.

6. The method as claimed in claim 1, where further analysing the well comprises comparing measured process values with triggering limits for the process values.

7. The method as claimed in claim 1, where determining the remedying action uses the calibrated drilling process models and current or past process values.

8. The method as claimed in claim 1, where determining the remedying action is repeatedly performed during the performance of the remedying action using at least current process values.

9. The method as claimed in claim 1, further comprising:

calculating instructions for machine controllers for controlling drilling operations using the calibrated drilling process models, the instructions for the machine controller defining a process parameter boundary and an emergency action to be taken automatically by the machine controller if a process parameter applied by an operator exceeds said process parameter boundary; and communicating the calculated instructions to the machine controller.

10. The method as claimed in claim 1, further comprising:

calculating instructions for a machine controller controlling drilling operations using the calibrated drilling process models, the instructions for the machine controller defining a dynamic remedying action to be taken automatically by the machine controller if an emergency action is taken; and communicating the calculated instructions to the machine controller.

11. The method as claimed in claim 9, wherein the instructions for the machine controllers comprise set points or curves or surfaces for machine controller algorithms implemented directly in the machine controllers.

12. The method as claimed in claim 10, wherein the instructions for the machine controllers comprise set points or curves or surfaces for machine controller algorithms implemented directly in the machine controllers.

13. The method as claimed in claim 1, further comprising:

predicting expected drilling process values on the basis of at least the calibrated drilling process model and past or current process values;

comparing previously predicted expected drilling process values with current process values; and if current process values deviate outside predetermined allowed deviation values, input remedying instructions to machine controllers in order to provide remedying performance process parameter from said controllers.

14. The method as claimed in claim 13, wherein the instructions for the machine controllers comprise set points or curves or surfaces for machine controller algorithms implemented directly in machine controllers.

15. The method as claimed in claim 1, wherein values and/or parameters used to calibrate the calibrated drilling process models are provided by application of one or more of the following systems:

i) a drilling machinery data acquisition system, which is an integrated part of a machine control system and which is adapted to provide control system values;

ii) a mud logging system; and iii) a downhole measurement data acquisition system, comprising downhole sensor tools for providing downhole measurements, such as downhole pressure, downhole temperature and survey measurements.

16. A drilling control system, for automatically triggering a remedying action responsive to an evolving or existing critical condition, the system comprising:

a process parameter calculation element operative to calculate process parameter boundaries which represent a critical condition for a well by using calibrated drilling process models, enforcement elements operative to trigger an emergency action if a process parameter exceeds said process parameter boundaries, said emergency action being intended to minimize the effect of said critical condition, a remedying action calculation element, operative to analyze the well further in order to determine a remedying action to then be applied, the remedying action being intended to remedy the cause of said critical condition the remedying action being determined dynamically as a function of the response of the well to the remedying action;

wherein the enforcement elements are operative to apply the remedying action and if said remedying action is not capable of remedying the cause of said critical condition, the enforcement elements are operative to apply predetermined safe process parameters or to shut down the well.

17. The drilling control system as claimed in claim 16, wherein the enforcement elements are machine controllers for controlling drilling operations, the machine controllers having machine controller algorithms directly implemented therein, where the behaviour of the machine controller algorithms is uniquely defined through machine controller instructions defining a process parameter boundary and an emergency action to be taken automatically by the machine controller if a process parameter applied by an operator exceeds said process parameter boundary.

18. The drilling control system as claimed in claim 16, wherein the enforcement elements are machine controllers for controlling drilling operations, the machine controllers having machine controller algorithms directly implemented therein, where the behaviour of the machine controller algorithms is uniquely defined through machine controller instructions defining a dynamic remedying action to be taken automatically by the machine controller if an emergency action is taken.

19. The drilling control system as claimed in claim 17, comprising a central database communicating calculated machine controller instructions defining triggering and dynamic remediating action to the machine controllers.

20. The drilling control system as claimed in claim 18, comprising a central database communicating calculated machine controller instructions defining triggering and dynamic remediating action to the machine controllers.

21. A drilling control system for automatically triggering a remedying action responsive to an evolving or existing critical condition, the drilling control system being adapted to apply calibrated drilling process models in calculating acceptable threshold conditions used to determine whether a well has entered a critical condition, wherein, in case a parameter is exceeding the continuously updated conditions for a critical situation, an automatic action is triggered to minimize the effect of the critical situation, wherein this automatic action can adapt itself as a function of the response of the well to the automatic action, and the system comprises machine controllers adapted to automatically trigger emergency remediating action based on machine controller algorithms implemented directly in the machine controllers; the machine controllers being arranged to apply a dynamic remediating action based on machine controller algorithms implemented directly in the machine controllers; and a central database communicating calculated setpoints or curves or surfaces defining emergency remediating action and dynamic remediating action to the machine controllers;

wherein the machine controllers are adapted to continuously compare measured process values with the triggering limits, and wherein, if triggering limits are exceeded then emergency remediating action is automatically triggered; and wherein after triggering, further remediating control is performed dynamically as a function of response, as defined by the setpoints or curves or surfaces defining appropriate dynamic remediating action.

* * * * *